US006261117B1

(12) United States Patent
LaCroix

(10) Patent No.: US 6,261,117 B1
(45) Date of Patent: Jul. 17, 2001

(54) DEVICE FOR CONNECTING AT LEAST TWO SHEATHED CONDUCTIVE WIRES

(76) Inventor: Jacques LaCroix, 12 Allee de la Pommeraie, 91570 Bievres (FR)

( * ) Notice: Subject to any disclaimer, the term of this patent is extended or adjusted under 35 U.S.C. 154(b) by 0 days.

(21) Appl. No.: 09/051,144

(22) PCT Filed: Sep. 26, 1996

(86) PCT No.: PCT/FR96/01501

§ 371 Date: Sep. 24, 1998

§ 102(e) Date: Sep. 24, 1998

(87) PCT Pub. No.: WO97/13293

PCT Pub. Date: Apr. 10, 1997

(30) Foreign Application Priority Data

Sep. 29, 1995 (FR) ..... 95 11455

(51) Int. Cl.[7] ..... H01R 4/24
(52) U.S. Cl. ..... 439/393; 439/417; 439/402
(58) Field of Search ..... 439/393, 417, 439/402, 397, 403, 888, 783, 863

(56) References Cited

U.S. PATENT DOCUMENTS

| | | | | |
|---|---|---|---|---|
| 3,243,757 | * | 3/1966 | Cobaugh | 439/888 |
| 3,257,635 | * | 6/1966 | Cobaugh | 439/888 |
| 3,350,679 | * | 10/1967 | Marley et al. | 439/417 |
| 4,435,034 | * | 3/1984 | Aujla et al. | 439/404 |
| 4,723,918 | * | 2/1988 | Lacroix | 439/417 |
| 4,820,191 | * | 4/1989 | Lacroix | 439/417 |
| 6,027,362 | * | 2/2000 | LaCroix | 439/404 |

* cited by examiner

*Primary Examiner*—Tho D. Ta
(74) *Attorney, Agent, or Firm*—Eugene C. Rzucidlo, Esq.

(57) ABSTRACT

The device comprises a casing, with a passage for introduction of an end portion of the sheathed wires, a catch for receiving the said end portions in the casing, a clip (12) arranged to be introduced into the casing transversely to the sheathes, with at least two slots (13) to grip the sheathes of the wires and to draw them towards the inside and the bottom of the casing and arranged to cooperate with the catch in order to strip the wires. Spacing means (52, 53) are also provided between the catch and the gripping and drawing clip (12) to keep their spacing greater than a cutting threshold.

15 Claims, 3 Drawing Sheets

DEVICE FOR CONNECTING AT LEAST TWO SHEATHED CONDUCTIVE WIRES

FIELD OF THE INVENTION

The present invention relates to a device for connecting at least two conductive wires each surrounded by an insulating sheath, comprising a casing in which a passage is provided for introduction of an end portion of the sheathed wires, means for receiving the said end portions in the casing, means arranged to be introduced into the casing transversely to the sheathes, comprising at least two slots to grip the sheathes of the wires and to draw them towards the inside and the bottom of the casing and which are arranged to cooperate with the means for receiving the sheaths in order to strip the wires longitudinally.

BACKGROUND OF THE INVENTION

The device of the invention serves to connect, mechanically and electrically, wires of a plurality of strands or preferably a single strand.

Connection devices of this type are already known, in particular from the French patent 86 15553, published under the number 2 606 558.

In the device of this patent a conductive clip, provided, between teeth, with slots for drawing the wires is displaced along a catch provided with an opening for receiving the wires with a lower edge forming a conductive stripping edge, to draw the ends of the wires towards the bottom of the casing and to strip the wires longitudinally.

The latter device was already an improvement on other devices of even older prior art, but it still not fully satisfactory.

The catch is carried by a slide, or plug, which is pushed into the casing to displace the lip along the catch and to produce the connection, the plug being pushed into the casing by the operator with the aid of a squeezing device.

It can happen that the plug is not perfectly introduced into the casing. In this case when it is pushed in the clip does not move parallel to the catch. This can also be the case by reason of the sole factor of the handling of the squeezing device. By tilting the clip a wedging effect between the clip and the catch can arise and cause not only the sheathes but the wires themselves to be cut.

SUMMARY OF THE INVENTION

The present invention thus aims to propose a connection device of the type mentioned above without the risk of cutting the wires.

To this end the connection device is characterised in that it comprises spacing means between the means for receiving the sheathed wires and the gripping and drawing means to keep their spacing greater than a cutting threshold.

The spacing means are preferably arranged so that the gripping and drawing means are introduced into the casing parallel to the means for receiving the sheathed wires.

In an advantageous embodiment of the device of the invention the spacing means are disposed on the gripping and drawing means.

In this case the spacing means can have been connected to the gripping and drawing means, for example, by soldering, or have been produced by forming the gripping and drawing means, for example, by embossing. It may be a positive formation on the side turned towards the reception means (boss, rib or any other projection), or a negative formation on the opposite side (groove).

It will be noted that the document GB-A-1 034 996 discloses a clip comprising a groove which is hollow on the side opposite to a catch but this groove in no way has the function of avoiding an effect of wedging between the two pieces. It serves only to receive the strands of a single wire. The idea of spacing does not appear in this document.

In the same way the document U.S. Pat. No. 3,963,318 involves the edges of a clip but only those which serve to stiffen it and especially to determine a cutting length for the conductors, unconnected with the spacers intended to avoid cutting the wires.

Still with the aim of avoiding cutting the wires, the passage for introducing sheathed wires into the casing advantageously comprises wire separation means with the aid of which the wires are prevented from crossing and being cut when the reception means and the gripping and drawing means cooperate.

BRIEF DESCRIPTION OF THE FIGURES

The invention will be better understood from reading the following description of a number of embodiments of the device of the invention made with reference to the attached drawing in which.

DETAILED DESCRIPTION OF THE INVENTION

Figure 1:
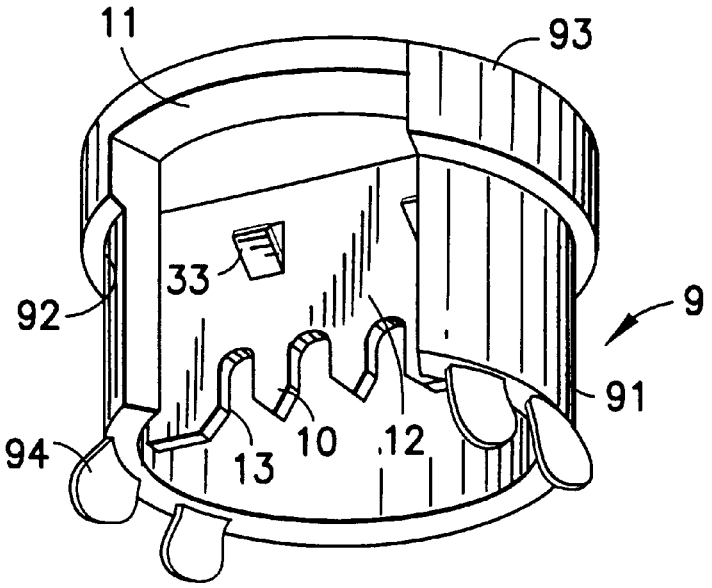
FIG. 1 illustrates a perspective view of the slide, or plug, of the device of the intention.

The device illustrated comprises a substantially cylindrical casing 1 comprising on its outer surface a hollow shaft 2 for introduction of the wires and which is substantially oblong in cross-section. The hollow shaft 2 extends at 2' inside the casing.

The casing is open on its upper face. The casing can, for example, be formed from moulded synthetic material which gives it a certain elasticity close to its opening.

Inside the casing, perpendicular to its open face and facing the opening of the extension 2' of the hollow shaft 2 and close to this opening, is located a rigid reception catch 3 which is substantially rectangular and comprises, as an extension of the hollow shaft 2, 2', an opening 4 intended to have the wires passing through it and of which the cross-section is substantially equal to that of the hollow shaft 2, or preferably slightly greater. The lower edge 4' of the catch closest to the bottom of the casing is rounded to avoid any slicing of the wires which might occur. The catch 3 is strong and a good conductor of electricity. The catch 3 comprises, in the lower part, a base 5 which is narrower and short and is introduced into a groove 6 provided in the bottom of the casing in order, when the catch is placed in the casing, to position it correctly.

On its face opposite to that turned towards the hollow shaft, the base 5 of the catch 3 has a lug 7 for locking in the adjacent wall of the adjacent wall of the groove 6 to prevent any rising which might occur. The lug 7 has been formed by embossing.

Behind the groove 6 and in its adjacent part, the bottom of the stepped casing 1 is raised at 20 in order to offer an abutment surface for the end portions of the wires which are to be connected, parallel to the hollow shaft 2, as well as for a clip which will be discussed further hereinunder. The abutment surface 20 extends towards the rear by a downwardly inclined surface.

The device also comprises a hollow slide, or plug, 9 also of a generally cylindrical shape.

The plug comprises a skirt 91, extending in this case substantially over two thirds of its height, of an external diameter slightly greater than the internal diameter of the upper opening of the casing at the largest part of its height, only the portion 92 of the skirt, adjacent to an annular shoulder formed by the closed upper part 93 of the plug, having an external diameter smaller than the internal diameter of the opening of the casing. When an operator fits together or pushes the plug into the casing, a click is produced when this part 92 passes the opening of the casing. In this pre-closure position of the device the upper part, or cap, 93 covers the inner edge of the opening of the casing. The cap 93 which is generally a truncated cone in shape has a lower part, which is of a larger cross-section than that of the opening of the casing, and an upper part of a smaller cross-section but which is still bigger than that of the opening of the casing. In this instance a squeezing device must be used to push the cap 93 into the casing in order to lock the assembly completely. It will be noted that the upper edge of the opening of the casing is lightly curved at 40 towards the inside (FIG. 3) and that a second click, louder than the first, is heard at the moment when the plug is forcibly and completely pushed into the casing. The lower end of the skirt has tabs 94 for provisional fixing together of the plug and of the casing before crimping and in order to store the assembly.

The elastic tabs 94 are curved towards the outside. After the tabs 94 are forced past the opening of the casing the lug 9 is connected to the casing.

The casing is also in this case formed from moulded synthetic material.

The plug 9 comprises a recess 11 though which the extension 2' of the hollow shaft 2 passes in the closed position.

The inside of the plug 9 is formed in such a way as to receive and hold in place a clip 12. The clip 12 consists of a substantially rectangular plate of which the narrowest edges 50, 51 have previously been curved by an angle of about 180°, each on the same side. It should be noted that in any case an angle of more than 90° would ensure the function. The diameter of the curves and the thickness of the plate forming the clip 12 are such that this clip, as will be shown later, comes to cooperate in a nesting manner with the catch 3. In the same way the catch 3 can have its edges curved instead of those of the clip 12 which would thus be planar, but this is a less satisfactory solution. The clip 12 comprises, in this case between the teeth 10, three slots 13, slightly narrower than the diameter of the core of the wires to be connected, in order to increase the contact surface provided from the lower part of the clip, which part is introduced into the casing first. Their height is slightly greater than the diameter of the sheath of the wires. For the purpose of the preliminary assembly of the plug 9 and of its clip 12, the clip 12 is arranged in the plug 9 so that the two curves come to face the recess 11. In the present example the clip 12 is held in place in the plug 9 by force and its positioning is ensured by grooves located on the lateral walls of the plug.

The clip 12 in this case has a single lug 33 for locking on the catch 3, obtained by embossing, by cooperation of the end of this lug with the upper edge of the opening 4 of the catch 3. Thus any rising of the clip which might occur is avoided. There may also be two lugs.

It should be noted that, in the closed position of the device, the lug 33 for locking the clip 12 on the catch 3, and the lug 7 for locking the catch 3 in the groove 6 at the bottom of the casing are substantially coplanar, and extend in any case in the same gap 14 separating the clip 12 and the catch 3. Moreover, these lugs 33 and 7 are directed in opposite directions from their respective foot, all this contributing to the quality of the locking.

The width of the gap 14 between the clip 12 and the catch 3 is smaller than the diameter of the core of the sheathed wires to be connected and in any case is kept greater than a cutting threshold by two bosses 52, 53 which are produced by embossing and protrude out of the side 54 of the clip 12 turned towards the catch 3 substantially in line with the curved edges 50, 51 and at the level of the slots 13. The bosses 52, 53, in this case two in number, are substantially rectangular in shape butt they could be of another shape.

The function of these bosses 52, 53 is thus that of spacer, ie. to maintain the spacing between the side 54 of the clip 12 and the catch 3 at least equal to their width, very slightly greater than the theoretical size designated "cutting threshold" with the air of avoiding cutting the wires. In this respect they are "anti-cutting" bosses.

It will be noted that it would be possible to provide spacing bosses on the catch 3 or even on both the clip 12 and the catch 3.

The bosses 52, 53 have been obtained by positive formation of the clip 12.

Figure 8:
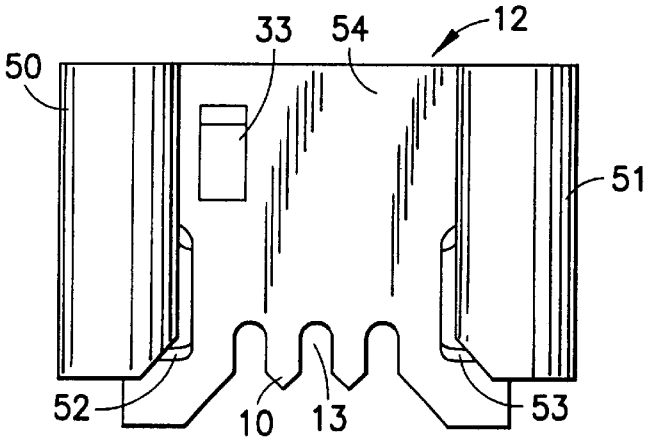
FIG. 8 illustrates a front view on a larger scale of the clip of the plug of the device.
Figure 9:
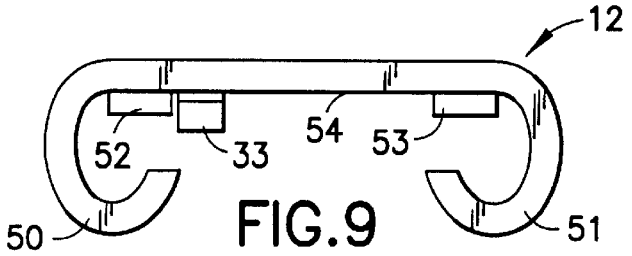
FIG. 9 illustrates a top view of the clip of FIG. 8.
Figure 10:
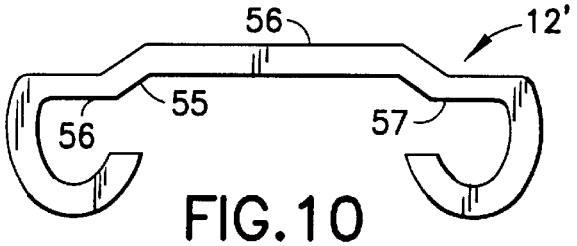
FIG. 10 illustrates a top view of a variation of the clip.

With reference to FIG. 10, the clip 12' has been embossed to form a groove 55 which is hollow towards the side 56 opposite to the catch 3 and is intended to receive the sheathed wires. In this case it is the lateral edges 57, 58 of this groove which act as a spacer or anti-cutting bosses. This is a negative formation as opposed to the positive formation of the clip 12 of FIGS. 8, 9.

The hollow shaft 2, and its extension 2',are hollowed out at 15 to serve as a reserve of grease after connection or crimping. In the same way longitudinal ribs 16 are provided in the casing of FIGS. 2, 3 in order to separate the sheathed wires properly in the hollow introduction shaft 2 and its extension 2' in order that the grease will enclose each wire properly as is the case in the casing of FIG. 7.

Figure 2:
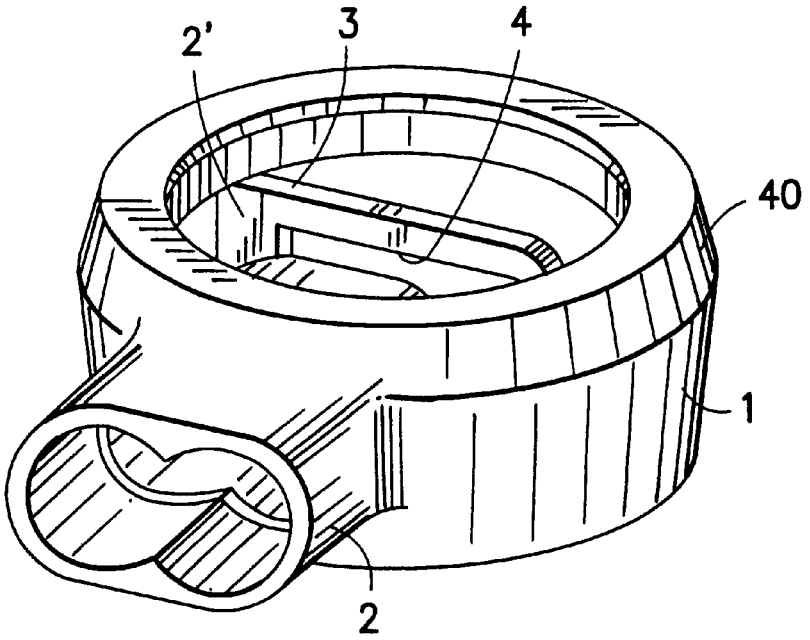
FIG. 2 illustrates a slightly different perspective view of the casing of the device of the invention.
Figure 3:
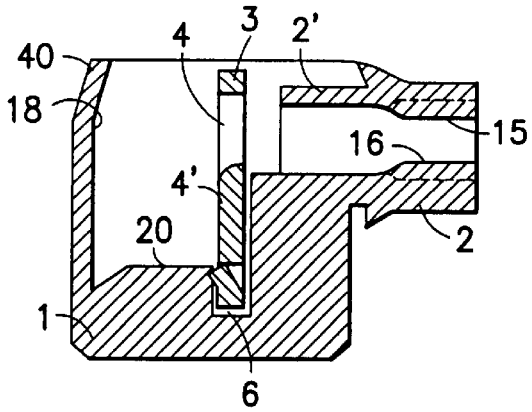
FIG. 3 illustrates a lateral cross-sectional view of the casing of FIG. 2.
Figure 4:
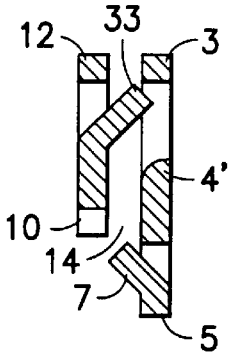
FIG. 4 illustrates a simplified partial cross-sectional view of the catch and of the clip of the device of the invention.
Figure 7:
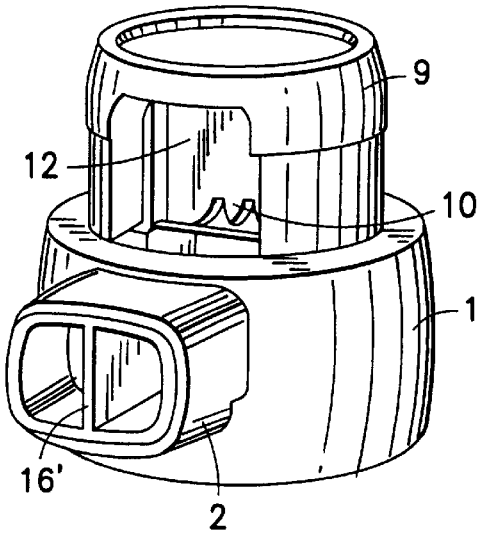
FIG. 7 illustrates a variation of the casing of the device with da diaphragm separating the wires.

The casing of FIG. 7, indeed, differs from that of FIGS. 2, 3 by the fact that the separation ribs in the hollow introduction shaft 2 extend as a diaphragm or partition 16' which properly separates the wires and prevents them from crossing and being cut between the teeth 10 of the clip 12.

The device operates as follows.

Figure 5:
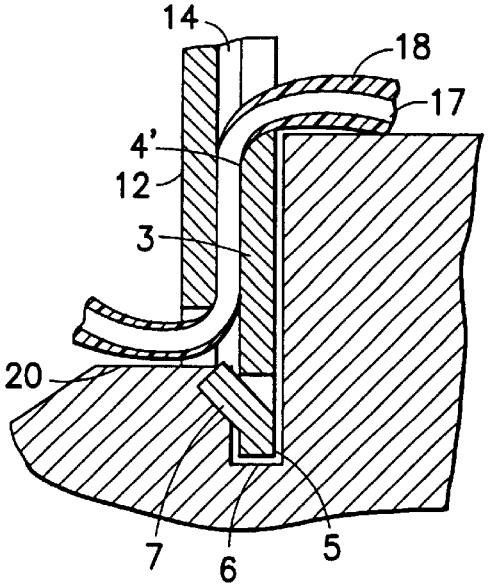
FIG. 5 illustrates a part of the view of FIG. 4 with a wire after it has been stripped.
Figure 6:
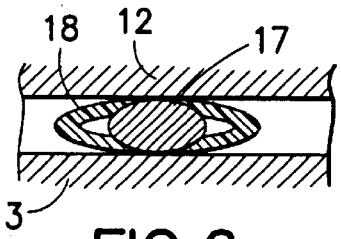
FIG. 6 illustrates a cross-sectional view of the stripped wire between the clip and the catch.

The non-stripped ends of the sheathed conductive wires, which are to be electrically and mechanically connected, are introduced via the introduction passage, or hollow shaft, 2, only one wire 17 being shown in FIG. 5.

The wires are introduced so that their end portion passes through the opening 4 of the receiving catch 3 and comes into abutment against the internal face 28 of the casing, opposite to the hollow shaft 2.

Then the plug 9 is brought against the casing 1 so that their open faces coincide and are parallel.

It should be noted that the catch 3 and clip 12 are respectively placed in the casing 1 and the plug 9 so that, when the plug passes into the casing, the clip 12 comes to nest with the catch 3, its two curved portions surrounding the catch edges, and to move along the catch 3 parallel thereto.

The plug 9 provided with the clip 12 has been pushed towards the inside of the casing 1, for example, with the aid of a universal squeezing device, until the slots 13 of the clip 12, after each having gripped the sheath of a wire to be connected, slightly beyond its free end, and having drawn the wire towards the inside and the bottom of the casing, place the end portions of the wires in abutment against the higher part of the bottom 20, the clip 12 itself coming into abutment against this bottom 20 after having forced the wires to pass completely into the slots 13.

The recess 11 permits the plug 9 to be pushed into the casing without the vertical position of the wires between the hollow shaft and the catch being altered.

When the wires, gripped in its slots 13, are drawn by the clip 12 they are bent, portion by portion, substantially to fit the two surface portions adjacent to the rounded edge 4' of the catch 3. At the same time by translation and crushing owning to the width of the gap 14, which is kept constant with the aid of the bosses 52, 53, the wires 17 are stripped over the length between the edge 4' of the catch and the bottom 20 of the casing by lateral plastic flow of the insulator 18.

In the lower part, the clip 12 and the bottom 20 bend the wires a second time but in the other direction so that once the connection is formed the catch 3, the clip 12 and the bottom 20 form a chicane for the wires which are thus firmly blocked.

Taking account of the direction of the movement of the clip 12, the bending angles of the wires are substantially 90° in one direction and the other.

Taking account of the movement of the wires and of the diameter of their core 17, the stripping is achieved by lastic flow of the sheaths 18 in the space between the clip and the catch.

Under these conditions the core of each wire is in electrical contact with the clip 12 and the catch 3 by means of the portion of the inner vertical wall adjacent to the opening 4. The cores of the wires are thus in electrical contact with each other.

By reason of the features of the device just described, its behaviour in the case of traction on at least one of the wires is excellent. All the elements are practically involved in locking of these wires: the lugs for locking the clip and the catch to each other, the lug for locking the catch and thus the clip between which the wires are well anchored, the locking of the plug on the casing. And this mechanical locking of the wires, of course, provides a high quality electrical connection. The sealing tightness of the device is also very good by reason of its cylindrical shape.

In the case of traction still on one wire, by the fact of the rounded edge of the opening of the passage of the catch, its core cannot be sliced. Nor can it be sliced by reason of the anti-cutting bosses.

By reason of the separating diaphragm, the sheathed wires are prevented from crossing in the hollow shaft and from being cut in a slot of the clip.

With the device just described it is possible to produce the simultaneous connection of three wires since the clip 12 in this case comprises three slots 13.

It is possible to connect wires with multiple strands or wires with a single strand, the device being particularly well adapted to the latter.

Under the reservation that the clip 12 is provided with a certain elasticity and that the slots 13 can grip them between their walls, wires of different diameters can be connected together.

Of course all modifications to the form of the device which do not affect its essential functions will be able to be produced without leaving the scope of the invention. In particular the clip may or may not be metallic in so far as it has no role as a conductor. It may, for example, be of a single piece with the plug. In the same way the catch can possibly be partially non-conductive.

By reason of the fact that the wires are introduced into the casing through the hollow shaft, its extension and the catch opening until they come into abutment against the opposite internal wall of the casing, it is advantageously possible slightly to hollow out the casing at this location to increase the length of wire thus introduced.

The invention is evidently useable in all types of industries where conductors have to be connected such as, for example, the electronic and telephone industries.

What is claimed is:

1. Device for connecting at least two conductive wires (17) each surrounded by an insulating sheath (18), comprising a casing (1) in which a passage (2) is provided for introduction of an end portion of the sheathed wires, means (3) for receiving said end portions in the casing, means (12) arranged to be introduced into the casing transversely to the sheaths, comprising at least two slots (13) to grip the sheaths of the wires and to draw them towards the inside and the bottom of the casing and which are arranged to cooperate with the means (3) for receiving said end portions in order to strip the wires longitudinally, characterized in that it comprises spacing means (52, 53; 56, 57) disposed on the gripping and drawing means (12) to keep the spacing between the means (3) for receiving said end portions and the gripping and drawing means (12) at greater than cutting threshold.

2. Device according to claim 1, wherein the spacing means have been attached to the gripping and drawing means.

3. Device according to claim 1, wherein the introduction passage (2) comprises means (16') for separating the sheathed wires.

4. Device according to claim 1, wherein the means for receiving the end portions of the sheathed wires comprise a catch (3) provided with an opening (4) with a rounded lower edge (4').

5. Device according to claim 1, wherein the spacing means (52, 53 ; 56, 57) have been produced by formation of the gripping and drawing means (12).

6. Device according to claim 5, wherein the spacing means (52, 53) have been produced by positive formation of the side (54) turned towards the means (3) for receiving said end portions.

7. Device according to claim 5, wherein the spacing means (56, 57) have been produced by negative formation of the side (56) opposite to the means for receiving said end portions.

8. Device according to claim 1, wherein the means (12) for gripping and drawing the sheathes comprise means (33)

for locking on the means (3) for receiving said end portions, the means (3) for receiving said end portions comprise means (7) for locking on the casing (1), the bottom of the casing is stepped and has an abutment surface (20) for the gripping and drawing means (12) and these means are carried by a plug (9) comprising an end portion (91) extending beyond the gripping and drawing slots (13), of a cross-section larger than a passage opening of the casing (1).

9. Device according to claim 8, wherein the plug (9) comprises a skirt (91) of a cross-section larger than the diameter of the passage opening of the casing (1) into which the plug has to be pushed, the skirt being connected to a cap (93) by a portion (92) of a cross-section smaller than the said diameter of the passage opening.

10. Device according to claim 1 wherein said means for receiving said end portions comprises a catch (3) provided with an opening (4) and said gripping and drawing means comprise a clip (12; 12') provided with anti-cutting bosses (52,53; 56,57).

11. Device according to claim 10, wherein the anti-cutting bosses (52, 53) have been obtained by embossing the side (54) of the clip (12) turned towards the catch (3).

12. Device according to claim 10, wherein the anti-cutting bosses (56, 57) are formed by the edges of a groove (55) obtained by embossing the side (56) of the clip (12') opposite to the catch (3).

13. Device according to claim 4, wherein the catch (3) is provided with a lug (7) for locking in a groove (6) of the casing (1) and the slip (12) is provided with a locking lug (33) arranged to cooperate with the upper edge of the opening (4) of the catch (3).

14. Device according to claim 13, wherein the anti-cutting bosses (52, 53) have been obtained by embossing the side (54) of the clip (12) turned towards the catch (3).

15. Device according to claim 13, wherein the anti-cutting bosses (56, 57) are formed by the edges of a groove (55) obtained by embossing the side (56) of the clip (12') opposite to the catch (3).

* * * * *